US006126350A

United States Patent [19]

Kageyama et al.

[11] Patent Number: 6,126,350

[45] Date of Patent: Oct. 3, 2000

[54] WRITING UTENSIL

[75] Inventors: Shuhei Kageyama; Sachio Arai, both of Kawagoe, Japan; Brian Booker, Newhaven, United Kingdom

[73] Assignee: The Gillette Company, Boston, Mass.

[21] Appl. No.: 09/128,081

[22] Filed: Aug. 3, 1998

Related U.S. Application Data

[63] Continuation of application No. PCT/JP97/00316, Feb. 7, 1997.

[30] Foreign Application Priority Data

Feb. 9, 1996 [JP] Japan ..... 8/24204
Jan. 10, 1997 [JP] Japan ..... 9/2964

[51] Int. Cl.[7] ..... B43K 21/61
[52] U.S. Cl. ..... 401/65; 401/53; 401/54
[58] Field of Search ..... 401/65, 53, 54

[56] References Cited

U.S. PATENT DOCUMENTS 4,836,703 6/1989 Kageyama et al. ..... 401/65
5,009,533 4/1991 Kageyama et al. ..... 401/65

FOREIGN PATENT DOCUMENTS 55-18227 4/1980 Japan .
226698 7/1990 Japan .
340633 8/1991 Japan .
5162492 6/1993 Japan .

*Primary Examiner*—Henry J. Recla
*Assistant Examiner*—Huyen Le
*Attorney, Agent, or Firm*—Ladas & Parry

[57] ABSTRACT

A writing instrument is provided in which assembling thereof can be finished by inserting a writing medium advancing mechanism into an outer barrel from the rear end side thereof, in which the outer appearance thereof is not injured and the assembling thereof is easy.

A lead advancing mechanism 10 has a chuck 13 connected with a front portion of a front tank member 12*a*, a chuck ring 14 surrounding an outer surface of the chuck 13, a sleeve 15 disposed so as to be able to contact a rear end of the chuck ring 14, a chuck spring 16 interposed between the sleeve 15 and a front end of the front tank member 12*b* to force the front tank member 12*b* backward. The sleeve 15 is formed with engaging projections 15*a* and with slits 15*b* each of which surrounds three sides of each engaging projection 15*a*, respectively, in such a manner that a resilient engaging means 15*c* is constructed, which can be resilient in radial directions of the sleeve. The resilient engaging portion 15*c* is engaged with a front end 3*b* of the rear barrel 3.

7 Claims, 8 Drawing Sheets

WRITING UTENSIL

This application is a continuation of copending application International Application PCT/JP97/00316 filed on Feb. 7, 1997 which designated the U.S. claims the benefit thereof and incorporates the same by reference.

TECHNICAL FIELD

This present invention relates to a writing instrument in which assembling of the writing instrument can be finished by inserting a writing medium advancing mechanism into an outer barrel from a rear end of the outer barrel.

BACKGROUND ART

A conventional writing instrument of this kind is disclosed as a mechanical pencil in Japanese Utility Model Publication No. 50156 of 1992 (Heisei 4), in which an engaging sleeve formed with an engaging portion is inserted between a head opening being provided at a front end portion of a lead advancing mechanism and an outer step portion provided behind the head opening. The engaging portion of the engaging sleeve for engaging the outer barrel is mounted between the head opening of the lead advancing mechanism and a front end of the outer barrel so that the lead advancing mechanism can be held by the outer barrel.

However, in such a conventional mechanical pencil, the engaging portion is exposed out of the outer barrel and so injures outward appearance, because the engaging portion is mounted between the head opening of the lead advancing mechanism and a front end of the outer barrel.

Accordingly, it is an object of the present invention to provide a writing instrument in which outer appearance thereof is not injured and assembling thereof is easy.

DISCLOSURE OF INVENTION

In order to achieve the above-mentioned object, in a writing instrument according to the present invention which comprises an outer barrel comprised of a front barrel and a rear barrel connected to the front barrel with a front end of the rear barrel being inserted in a rear end of the front barrel and a writing medium advancing mechanism assembled in the outer barrel by inserting the writing medium advancing mechanism into the outer barrel from a rear end side of the outer barrel. The writing instrument is characterized in that the writing medium advancing mechanism has a sleeve provided with resilient engaging means on an outer surface of the sleeve, the resilient engaging means being displaceable in radial directions, a step portion is formed on an inner surface of the front barrel, a front end portion of the sleeve is brought into contact with the step portion of the front barrel and the resilient engaging means of sleeve is engaged with the front end of the rear barrel so that the writing medium advancing mechanism is held in the outer barrel, and the sleeve is provided with an elastic portion which can be elastic in an axial direction of the sleeve, between the front end portion of the sleeve and the resilient engaging means of the sleeve.

When the writing medium advancing mechanism is inserted into the outer barrel from the rear end side of the outer barrel during assembling, the front end portion of sleeve is brought into contact with the step portion formed within the front barrel, and the resilient engaging means is engaged with the front end of the rear barrel so that the writing medium advancing medium can be held within the outer barrel.

Since the writing medium advancing mechanism is assembled into the outer barrel by that the resilient engaging means is engaged with the front end of the rear barrel, assembling of writing instrument is easy and outer appearance thereof is not injured.

Since the sleeve is provided with the elastic portion, even if there is a dimensional error on a distance of from the front end portion of sleeve to the resilient engaging means, or a dimensional error on a distance of from the step portion of front barrel to the front end of rear barrel, the errors on the above-mentioned distances can be compensated through the expansion and contraction of the elastic portion. Accordingly, the writing medium advancing mechanism can be mounted surely within the outer barrel.

Further, the resilient engaging means is preferably comprised of an engaging projection formed on the sleeve and a slit formed in the vicinity of the engaging projection. Accordingly, a simple structure comprised of an engaging projection and a slit forms the resilient engaging means which is displaceable in the radial direction.

Further, the elastic portion has preferably a slot formed on the circumferential surface of the sleeve with extending in a circumferential direction of the sleeve, or the elastic portion can be comprised of a coiled portion formed as an integral part of the sleeve, or the elastic portion can be comprised of a spiral twisted portion formed as an integral part of the sleeve. Accordingly, the sleeve can be surely elastic in the axial direction thereof.

Further, the writing medium advancing mechanism may be a lead advancing mechanism and the lead advancing mechanism is comprised of a lead tank, a chuck coupled to the lead tank, a chuck ring surrounding an outer surface of the chuck, the sleeve disposed so as to be able to contact a rear end of said chuck ring, and a chuck spring interposed between said sleeve and the lead tank to force the lead tank backward. Accordingly, a writing instrument of the present invention can be applied to a mechanical pencil in which a lead is advanced.

Further, the writing medium advancing mechanism may be a refill advancing mechanism and the refill advancing mechanism is comprised of a refill, the sleeve, a spring interposed between the sleeve and the refill to force the refill backward, rotating cam means contacting a rear end of the refill, knocking cam means for pushing the rotating cam means forward, and cam body means having a cam surface for making the rotating cam means rotate by a predetermined angle along the cam surface of the cam body means. Accordingly, a writing instrument of the present invention can be applied to a ball-point pen in which a refill is advanced.

BEST MODE FOR CARRYING OUT THE INVENTION

Figure 1:
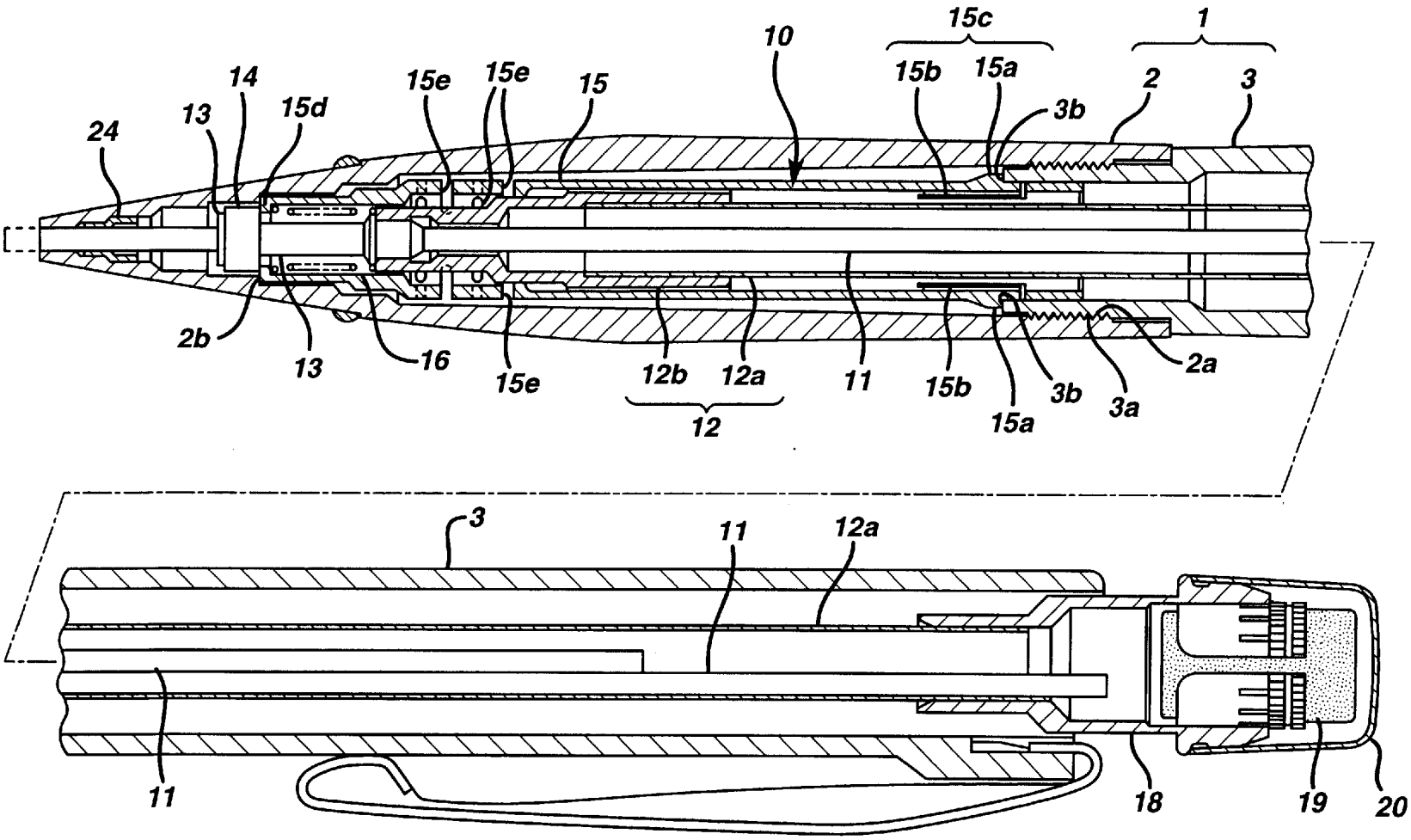
FIG. 1 is a vertical section of a first embodiment of writing instrument according to the present invention, showing an example applied for a mechanical pencil.

Referring to the drawings, embodiments of writing instruments according to the present invention are explained.

FIG. 1 shows a first embodiment of writing instrument applied for a mechanical pencil.

As shown in FIG. 1, a mechanical pencil comprises an outer barrel 1, which is comprised of a front barrel 2 and a rear barrel 3 connected to the front barrel 2, in which a front end of the rear barrel 3 is inserted into a rear end of the front barrel 2. The inside of the rear end of front barrel 2 is formed with a female screw portion 2*a*, while the outside of the front end of rear barrel 3 is formed with a male screw portion 3*a*. Female screw portion 2*a* is engaged with male screw portion 3*a* so that front barrel 2 is connected with rear barrel 3. However, the connection between front barrel 2 and rear barrel 3 can be made not only by screwing rear barrel 3 to front barrel 2 but also by the force fit of rear barrel 3 into front barrel 2. Further, the connection between front barrel 2 and rear barrel 3 can be made by securing rear barrel 3 to front barrel 2 with adhesives.

A lead advancing mechanism 10 as a writing medium advancing mechanism is mounted within outer barrel 1, which is assembled into the outer barrel 1 by inserting the lead advancing mechanism 10 into outer barrel 1 from the rear end side thereof. The lead advancing mechanism 10 has a lead tank in which leads as writing medium are accommodated. The lead tank 12 is comprised of a tubular rear tank member 12*a* and a front tank member 12*b* connected with the rear tank member 12*a* by the force fit. Alternatively, rear tank member 12*a* may be formed as an integral part of front tank member 12*b*.

Lead advancing mechanism 10 further has a chuck 13 connected with a front portion of the front tank member 12*b*, a chuck ring 14 surrounding an outer surface of the chuck 13, a sleeve 15 disposed so as to be able to contact a rear end of the chuck ring 14, a chuck spring 16 interposed between sleeve 15 and a front end of the front tank member 12*b* to force the front tank member 12*b* backward, a knocking member 18 attached to a rear end of the rear tank member 12*a* of lead tank 12, an eraser 19 with a jacket inserted into the knocking member 18, and a cap 20 removably attached to knocking member 18 for covering eraser 19.

Figure 2:
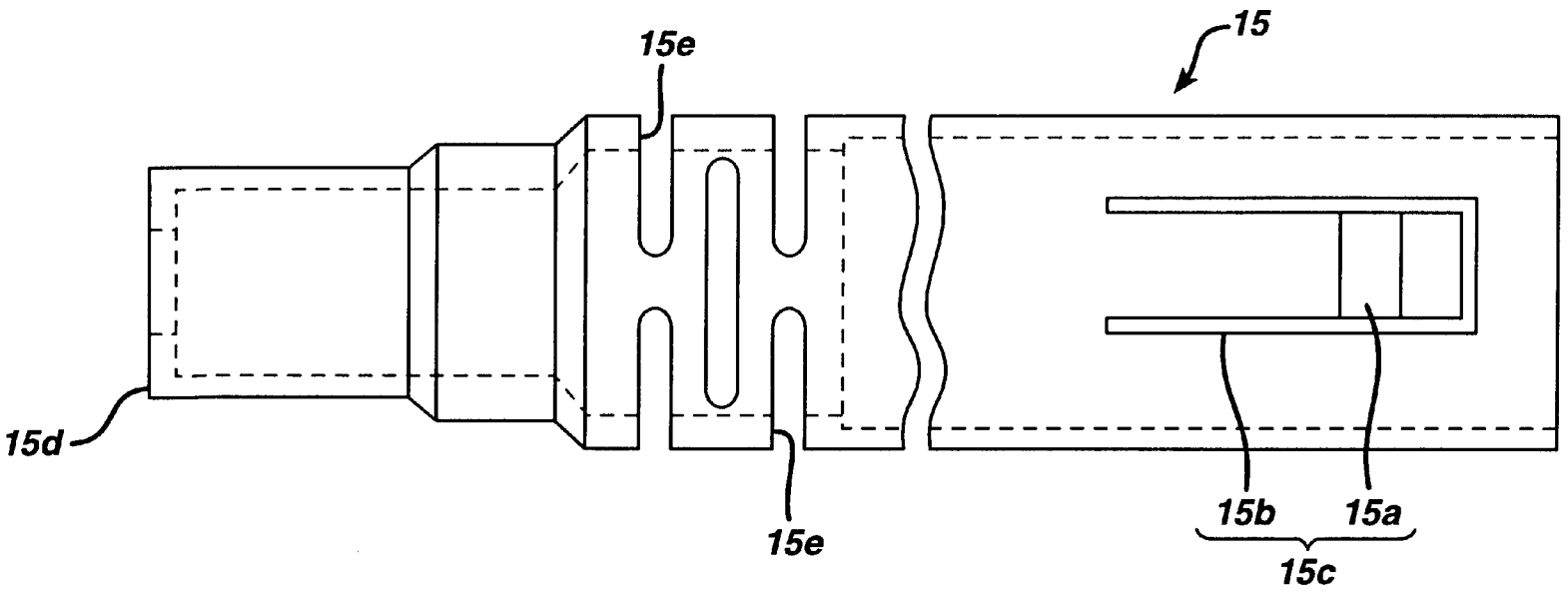
FIG. 2 is a plan view of a sleeve used in a mechanical pencil in the embodiment shown in FIG. 1.

As shown in FIG. 2, sleeve 15 is formed with engaging projections 15*a* at an upper portion and a lower portion on an outer surface of a rear portion of sleeve 15, respectively, and with slits 15*b* each of which surrounds three sides of each engaging projection 15*a*, respectively. A resilient engaging means 15*c* is comprised of the engaging projections 15*a* and the slits 15*b*, and can be resilient in radial directions of the sleeve 15. Further, an area on the outer surface of sleeve 15 between a front end portion 15*d* of sleeve 15 and resilient engaging means 15*c* has a plurality of slots 15*e* extending in circumferential directions of sleeve 15. The area formed with the slots 15*e* is an elastic portion which is elastic in an axial direction of sleeve 15.

In FIG. 1, numeral 24 designates a rubber packing mounted at a front portion of the inside of front barrel 2.

In assembling of a writing instrument, the pre-assembled lead advancing mechanism 10 is inserted into rear barrel 1 from the rear end side of outer barrel 1 equipped with rubber packing 24, and engaging projections 15*a* of sleeve 15 are moved forward under the condition that the engaging projections 15*a* are elastically deformed inward in the radial directions of sleeve 15. Finally, the front end portion 15*d* of sleeve 15 is brought into contact with a step portion 2*b* formed on the inside of front barrel 2, while engaging projections 15*a* pass a front end 3*b* of rear barrel 3 and are engaged with the front end 3*b* of rear barrel 3.

In order that lead advancing mechanism 10 is surely mounted within outer barrel 1 through the sleeve 15, it is desirable that a distance between outer surfaces of two engaging projections 15*a* opposed diametrically under the condition that the engaging projections 15*a* are not yet deformed in the radial directions of sleeve 15 is set to be larger than an inner diameter of rear barrel 3, and a distance of from the front end portion 15*d* of sleeve 15 to an rear face of each engaging projection 15*a* under the condition that elastic portion 15*e* is not yet deformed in the axial direction of sleeve 15 is set to be slightly larger than a distance of from the step portion 2*b* of front barrel 2 to the front end 3*b* of rear barrel 3. Namely, under the condition that sleeve 15 is mounted within outer barrel 1, the elastic portion 15*e* forces sleeve 15 with being slightly compressed in the axial direction thereof. Even if there is a dimensional error on a distance of from the front end portion 15*d* of sleeve 15 to the rear faces of engaging projections 15*a* under the condition that elastic portion 15*e* is not yet deformed, or a dimensional error on a distance of from step portion 2*b* of front barrel 2 to front end 3*b* of rear barrel 3, the errors on the above distances can be compensated through the expansion and contraction of elastic portion 15*e*.

In such a way, assembling of mechanical pencil is finished by one operation in which the pre-assembled lead advancing mechanism 10 is inserted into outer barrel 1 from the rear end side of outer barrel 1. Since engaging projections 15*a* and slits 15*b* are positioned within outer barrel 1, outward appearance of a writing instrument of the present invention is not injured.

When the writing instrument according to this embodiment is used for writing, knocking member 18 is knocked in the same manner as in conventional mechanical pencils, the chuck 13 connected with lead tank 12 is moved forward against a spring force due to chuck spring 16, by which lead 11 is advanced by a given length from chuck 13 in the same manner as in a conventional lead advancing mechanism, by which lead 111 is extruded from the front end of front barrel 2.

Further, when excessive writing pressure is applied to lead 11 during writing, a force making sleeve 15 move backward is applied to sleeve 15 through chuck 13 and chuck ring 14, in which elastic portion 15*e* acts as a cushion spring which absorbs the excessive writing pressure, so that breaking of lead can be prevented by expansion and contraction of elastic portion 15*e*.

Figure 3:
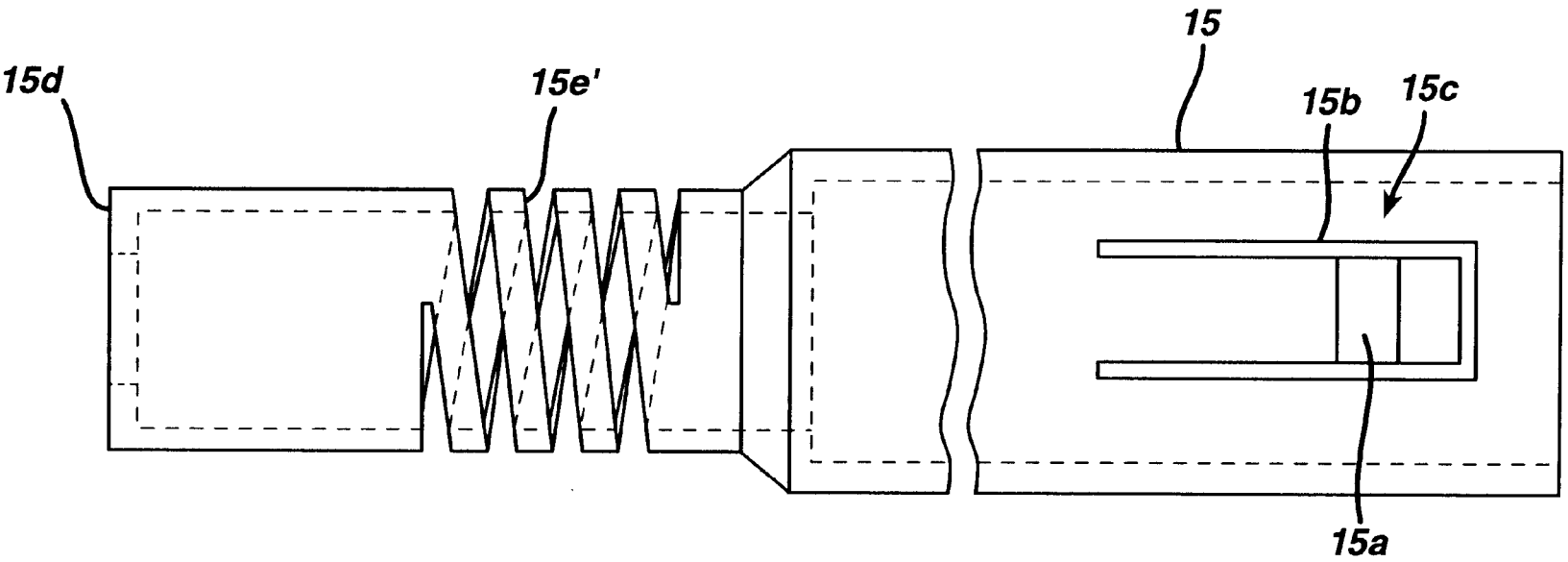
FIG. 3 is a plan view showing a modified embodiment of a sleeve.

FIG. 3 shows a modified embodiment of sleeve 15, in which instead of slots extending in the circumferential directions of sleeve 15, coiled connecting piece 15*e*′ as elastic portion is formed as an integral part of sleeve 15, which connects a front area of sleeve 15 with a rear area thereof.

Figure 4:
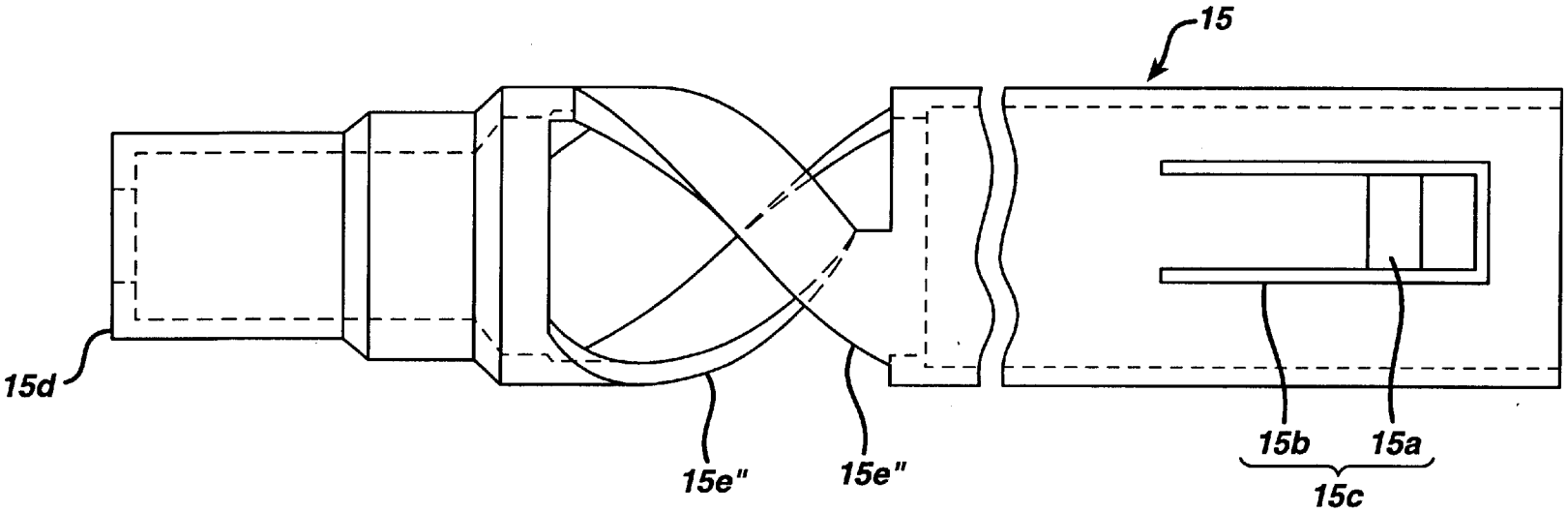
FIG. 4 is a plan view of another modified embodiment of a sleeve.

Further, FIG. 4 shows another modified embodiment of sleeve 15, in which instead of coiled connecting pieces as shown in FIG. 3, a plurality of spiral connecting pieces 15*e*″ (two spiral connecting pieces in this embodiment), as elastic portion 15*e*″ are formed as integral parts of sleeve 15, which connect a front area of sleeve 15 with a rear area thereof.

Figure 5:
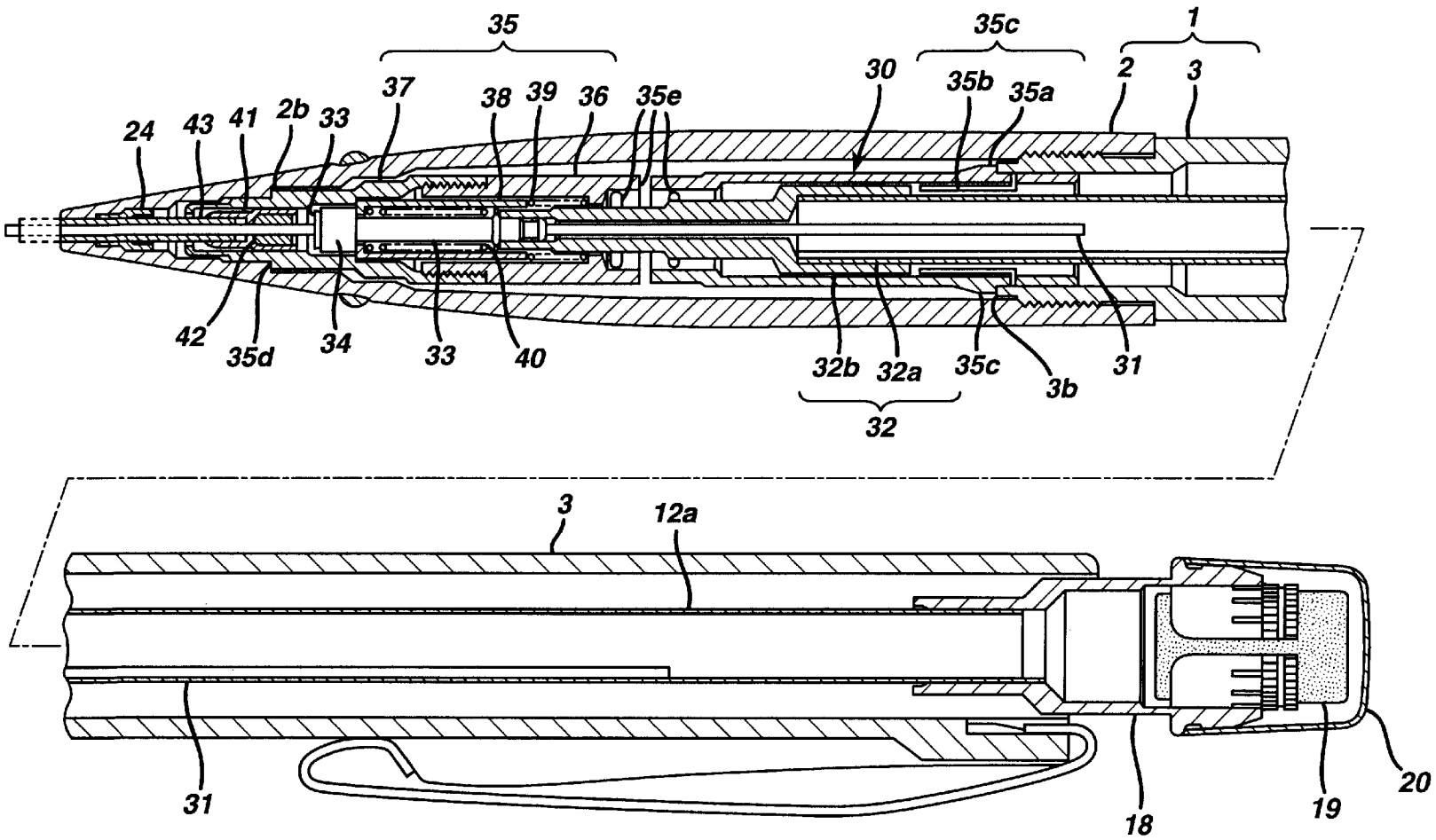
FIG. 5 is a vertical section of a second embodiment of writing instrument according to the present invention, showing another example applied for a mechanical pencil.

FIG. 5 is a vertical section showing another example applied for a mechanical pencil. The present example relates to a mechanical pencil in which the same outer barrel as outer barrel 1 used in the first embodiment is used, lead advancing mechanism 30 holding leads 31 having a smaller diameter than lead 11 is inserted into outer barrel 1 from the rear end side thereof to be mounted within outer barrel 1.

Namely, lead advancing mechanism 30 of the present example has a lead tank 32 comprised of a rear tank member 32*a* and a front tank member 32*b* for accommodating leads 31, a chuck 33 connected with a front portion of front tank member 32*b,* a chuck ring 34 surrounding the outside of chuck 33, a sleeve 35 disposed so as to be able to contact a rear end of chuck ring 34, a chuck spring 40 interposed between sleeve 35 and a front end of front tank member 32*b* to force the front tank member 32*b* backward, a knocking member 18 into which a rear end of rear tank member 32*a* of lead tank 32 is inserted, an eraser 19 with a jacket inserted into knocking member 18, and cap 20 removably attached to knocking member 18 for covering eraser 19.

Sleeve 35 is comprised of a rear sleeve 36, a front sleeve 37 threadably connected with the rear sleeve 36, a middle sleeve 38 disposed within rear sleeve 36 and front sleeve 37, and a cushion spring 39 interposed between rear sleeve 36 and middle sleeve 38. Rear sleeve 36 is formed with engaging projections 35*a* at an upper portion and a lower portion on an outer surface of a rear portion of rear sleeve 36, and with slits 35*b* each of which surrounds three sides of each engaging projection 35*a.* A resilient engaging means 35*c* is comprised of the engaging projections 35*a* and the slits 35*b* so that the resilient engaging means 35*c* can be elastic in radial directions of rear sleeve 36. Further, an area on the outer surface of rear sleeve 36 being in front of elastic engaging means 35*c* has a plurality of slots 35*e* extending in circumferential directions of sleeve 35. The area formed with the slots 35*e* is an elastic portion which is elastic in an axial direction of sleeve 35.

A front end portion of front sleeve 37 is formed with a step portion 35*d* being able to contact step portion 2*b* formed on the inside of front barrel 2. Further, a lead pipe 43, a rubber packing 42 connected with lead pipe 43 through a slider 41 are arranged within a front portion of an inside of front sleeve 37 so as to be movable in an axial direction thereof. The rubber packing 42 supports a lead 31 by coming into contact with the lead 31.

Further, rubber packing 42 set within a front portion of the inside of front barrel 2 holds the lead pipe 43 to keep it projected out of the head of front barrel 2.

When the above-described lead advancing mechanism 30 is inserted into outer barrel 1 from the rear end side thereof during assembly, engaging projections 35*a* of sleeve 35 are moved forward with being deformed inward in the radial directions of rear barrel 3. Finally, step portion 35*d* of sleeve 35 (front sleeve 37) is brought into contact with step portion 2*b* formed on the inside of front barrel 2, while engaging projections 35*a* pass front end 3*b* of rear barrel 3 and are engaged with front end 3*b* of rear barrel 3. In the same manner as in the first embodiment, it is desirable that a distance between outer surfaces of two engaging projections 35*a* positioned diametrically under the condition that the engaging projections 35*a* are not yet deformed in the radial directions of sleeve 35 is set to be larger than an inner diameter of rear barrel 3, while a distance of from the step portion 35*d* of sleeve 35 to an rear face of each engaging projection 35*a* under the condition that elastic portion 35*e* is not yet deformed in the axial direction of sleeve 35 is set to be slightly larger than a distance of from step portion 2*b* of front barrel 2 to front end 3*b* of rear barrel 3. Further, under the condition that sleeve 35 is mounted within outer barrel 1, the elastic portion 35*e* forces sleeve 35 with being slightly compressed in the axial direction thereof. Even if there is a dimensional error on a distance of from the step portion 35*d* of sleeve 35 to the rear faces of engaging projections 35*a* under the condition that elastic portion 35*e* is not yet deformed, or a dimensional error on a distance of from step portion 2*b* of front barrel 2 to front end portion 3*b* of rear barrel 3, the errors on the above distances can be compensated through the expansion and contraction of elastic portion 35*e,* in the same manner as in the first embodiment.

In such a way, assembling of mechanical pencil is finished by one operation in which lead advancing mechanism 30 is inserted into outer barrel 1 from the rear end side thereof. As explained in this embodiment, a sleeve can be composed of a plurality of members.

When the writing instrument according to this embodiment is used for writing, a lead 31 and a lead pipe 43 can be projected out of the front end of front barrel 2 by knocking the knocking member 18 in the same manner as in the first embodiment.

Further, when excessive writing pressure is applied to a lead 31 during writing, a force making middle sleeve 38 move backwards is applied to middle sleeve 38 through chuck 33 and chuck ring 34. Cushion spring 39 absorbs the excessive writing pressure by being elastic. Further, the excessive writing pressure can be absorbed not only by a cushion spring 39 but also by elastic portion 35*e* provided in rear sleeve 36 being elastic.

Figure 6:
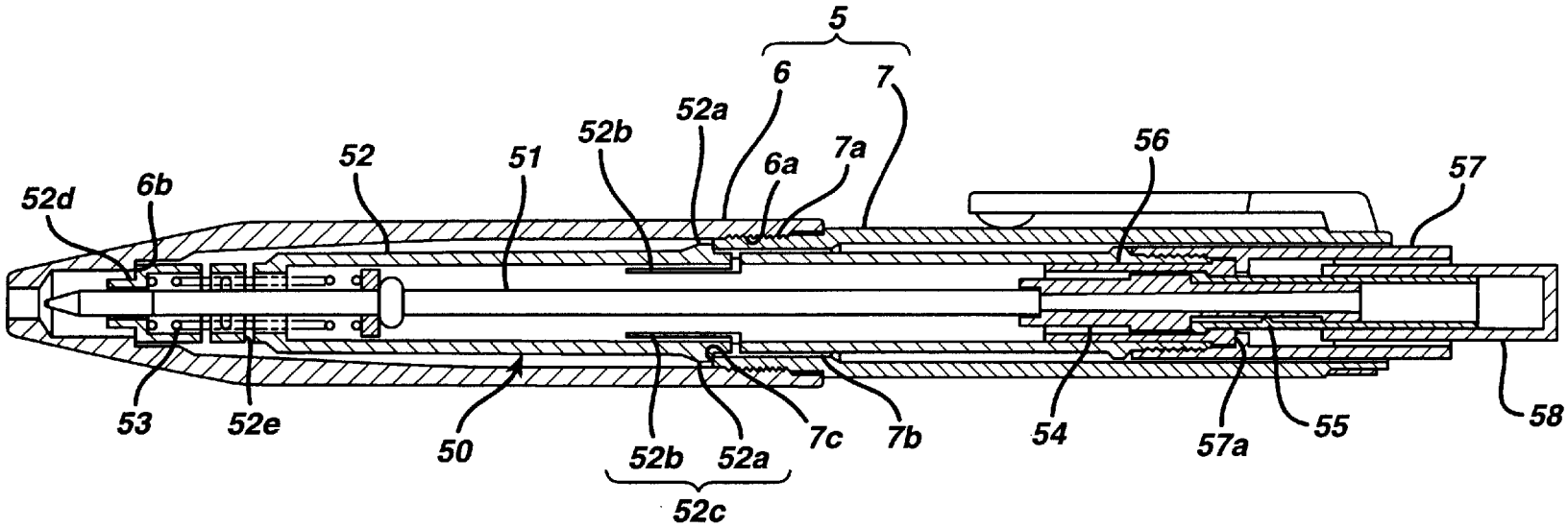
FIG. 6 is a third embodiment of writing instrument according to the present invention, showing an example applied for a ball-point pen.

FIG. 6 is a vertical section showing a second embodiment of writing instrument according to the present invention applied for a ball-point pen.

In FIG. 6, numeral 5 designates an outer barrel, which is comprised of a front barrel 6 and a rear barrel 7 connected with front barrel 6 by inserting a front end of the rear barrel 7 into a rear end of front barrel 6. The rear end of the inside of front barrel 6 is formed with a female screw portion 6*a,* while the front end of the outside of rear barrel 7 is formed with a male screw portion 7*a,* in which front barrel 6 is connected with rear barrel 7 by screwing rear barrel 7 to front barrel 6. However, the connection between front barrel 6 and rear barrel 7 can be made not only by screwing rear barrel 7 to front barrel 6 but also by the force fit of rear barrel 7 into front barrel 6. Further, the connection between the two can be made by securing rear barrel 7 to front barrel 6 with adhesives. Further, the inside of rear barrel 7 has a polygonal portion 7*b* which is connected with a sleeve 52 explained hereinafter.

A refill advancing mechanism 50 as writing medium advancing mechanism is mounted within outer barrel 5 by inserting the refill advancing mechanism 50 into outer barrel 5 from the rear end side of outer barrel 5.

Refill advancing mechanism 50 has a refill 51 which is replaceable for containing ink as writing medium, the sleeve 52, a spring 53 interposed between the refill and the sleeve 52 to force refill 51 backward, rotating cam 54 contacting a rear end of the refill 51, a knocking cam 55 for pushing the rotating cam 54 forward, a cam body 56 having a cam surface for making the rotating cam 54 rotate by a predetermined angle along the cam surface, a tail stopper 57 which is threadably removably connected to the rear end of sleeve 52, and a knocking member 58.

A circular projecting portion 57*a* is formed on a middle inside In the axial direction of tail stopper 57. The rear end of cam body 56 is press-fitted and secured in such a manner that a rear end of cam body 56 is brought into contact with a front end of projecting portion 57*a*. Knocking bar 58 is positioned in a rear side of the projecting portion 57*a*. A rear end of knocking cam 55 is press-fitted and secured into knocking bar 58 from a front end side of cam body 56.

On cam body 56, conventional shallow grooves and deep grooves are alternately formed, with separated with each other by ridges. Front edges of the shallow grooves and the front edges of the ridges form a sawteeth shaped cam surface. A front end portion of knocking cam 55 engages each groove, while rotating cam 54, which is forced backward through refill 51 by spring 53, is positioned selectively either in the deep grooves or at the cam surface of the front edges of the shallow grooves. It is not shown in figures, however, projections are provided on any one of the outer-circumferential surface of rotating cam 54 and the inner circumferential surface of knocking cam 55, while the other one is provided with engaging portions which can be engaged with the projections, in such a manner that when rotating cam 54 moves forward relative to knocking cam 55 by some distance in the axial direction of rotating cam 54, rotating cam 54 cannot be advanced further with the projections being engaged with engaging portions. In this way, when replacing the refill 51 as explained hereinafter, rotating cams 54 are prevented from being dropped out of knocking cam 55.

Figure 7:
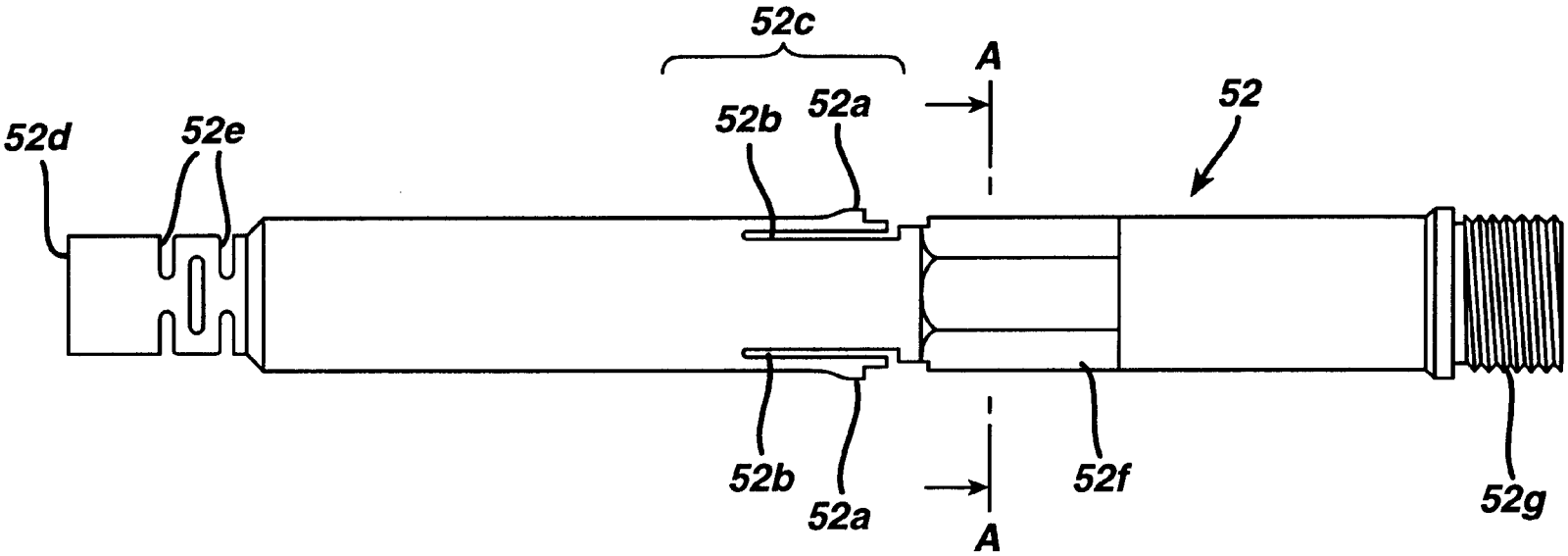
FIG. 7 is a plan view of a sleeve used in a ball-point pen in the embodiment shown in FIG. 6.
Figure 8:
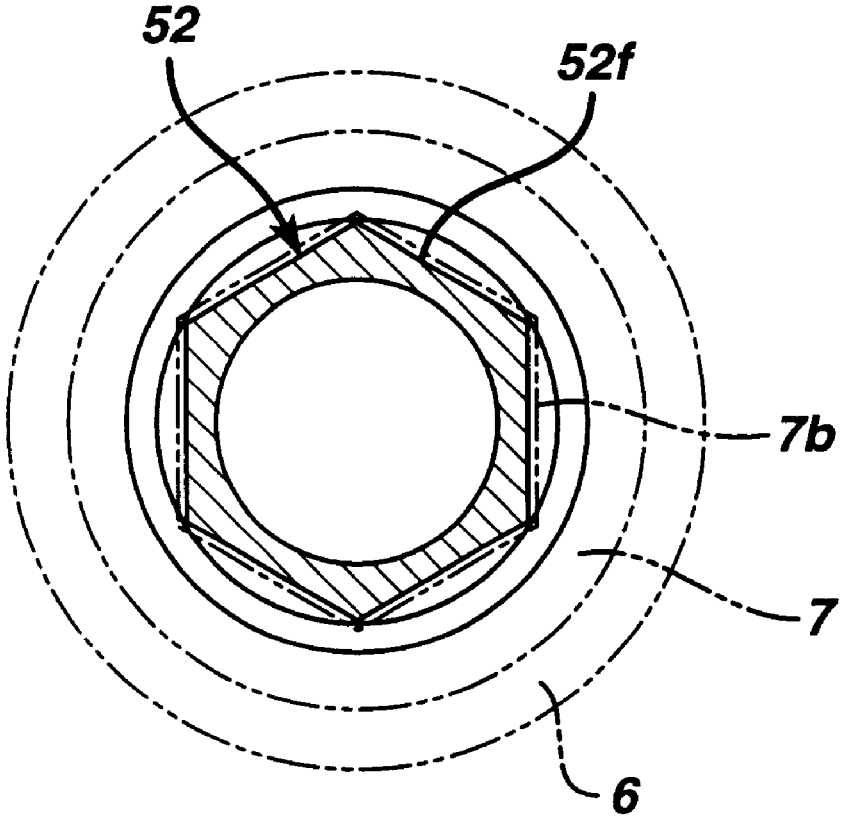
FIG. 8 is a sectional view taken along A—A line of FIG. 7.

As shown in FIG. 6, sleeve 52 is formed with engaging projections 52*a* at an upper portion and a lower portion of an outer surface of the rear portion of sleeve 52, respectively, and with slits 52*b* each of which surrounds three sides of each engaging projection 52*a*. A resilient engaging means 52*c* is comprised of the engaging projections 52*a* and the slits 52*b* so that the resilient engaging means 52*c* can be elastic in radial directions of the sleeve 52. Further, an area on the outside of sleeve 52 between a front end portion 52*d* of sleeve 52 and resilient engaging means 52*c* has a plurality of slots 52*e* extending in circumferential directions of sleeve 52. The area formed with the slots 52*e* is an elastic portion which is elastic in an axial direction of sleeve 52. Further, as shown in FIG. 7, an area of sleeve 52 in the rear of elastic engaging means 52*c* has a polygonal portion 52*f* of octagon, which is engaged with polygonal portion 7*b* of rear barrel 7 so that relative rotation is prohibited between rear barrel 7 and sleeve 52. Male screw portion 52*g* formed at the rear end of sleeve 52 is engaged with tail stopper 57.

The refill advancing mechanism 50 is assembled in the same manner as in the former embodiments, by inserting the above-explained refill advancing mechanism 50 into outer barrel 5 from the rear end side thereof in such a manner that polygonal portions 7*b* of rear barrel 7 is matched with polygonal portion 52*f* of sleeve 52. Front end portion 52*d* of sleeve 52 is brought into contact with a step portion 6*b* formed in the inside of front barrel 6, while engaging projections 52*a* pass a front end 7*c* of rear barrel 7 to be engaged with the front end 7*c* of rear barrel 7. Even if there is a dimensional error on a distance of from front end portion 52*d* of sleeve 52 to the rear faces of engaging projections 52*a*, or a dimensional error on a distance of from step portion 6*b* of front barrel 6 to front end 7*c* of rear barrel 7, the errors on the above distances can be compensated through the expansion and contraction of elastic portion 52*e*.

When the writing instrument according to this embodiment is used for writing, knocking cam 55 is advanced by knocking knocking bar 58, rotating cam 54 and refill 51 are moved forward against a spring force due to spring 53 so that rotating cam 54 is rotated along the cam surface of cam body 56 by a given angle, and positioned at the front edges of the shallow grooves, and refill 51 is secured under the state that refill 51 is projected out of front barrel 6. Further, when knocking bar 58 is again knocked, rotating cam 54 is rotated by a given angle to be fitted into the deep grooves of cam body 56, and is held under the state that refill 51 is retreated from front barrel 6.

When replacing refill 51, tail stopper 57 is rotated relative to outer barrel 5. Prohibition of rotation between rear barrel 7 of outer barrel 5 and sleeve 52 due to polygonal portions 7*b* and 52*f* leads the rotation to rotation of tail stopper 57 relative to sleeve 52, by which the connection between the two by screwing one to another is unfastened so that cam body 56, knocking cam 55, knocking bar 58, and rotating cam 54 prevented from being dropped out of knocking cam 55 can be removed and be taken from sleeve 52 together with tail stopper 57. Therefore, refill 51 can be taken from the rear end of outer barrel 5. If new refill 51 is inserted into sleeve 52, and then tail stopper 57 is screwed to sleeve 52, writing again becomes possible.

In the respective embodiments, resilient engaging means are provided at upper and lower positions. However, the present invention is not restricted to this. The engaging of the sleeve with the rear barrel can be made more secure by providing more than two resilient engaging means on the sleeve.

We claim:

1. A writing instrument comprising an outer barrel comprised of a front barrel and a rear barrel connected to the front barrel with a front end of the rear barrel being inserted in a rear end of the front barrel and a writing medium advancing mechanism assembled in the outer barrel by inserting the writing medium advancing mechanism into the outer barrel from a rear end side of the outer barrel, wherein the writing medium advancing mechanism has a sleeve provided with resilient engaging means on an outer surface of the sleeve, the engaging means being displaceable in radial direction, a step portion is formed on an inner surface of the front barrel, a front end portion of the sleeve is brought into contact with the step portion of the front barrel and the resilient engaging means of sleeve is engaged with the front end of the rear barrel so that the writing medium advancing mechanism is held in the outer barrel, and the sleeve is provided with an elastic portion which can be elastic in an axial direction of the sleeve, between the front end portion of the sleeve and the engaging means of the sleeve.

2. The writing instrument as claimed in claim 1 wherein the resilient engaging means is comprised of an engaging projection formed on the sleeve and a slit formed in the vicinity of the engaging projection.

3. The writing instrument as claimed in claim 1 wherein the elastic portion has a slot formed on a circumferential surface of the sleeve, said slot extending in a circumferential direction of the sleeve.

4. The writing instrument as claimed in claim 1 wherein the elastic portion is comprised of a coiled connecting piece integrally formed on the sleeve.

5. The writing instrument as claimed in claim 1 wherein the elastic portion is comprised of a plurality of spiral twisted connecting pieces integrally formed on the sleeve.

6. The writing instrument as claimed in claim 1 wherein the writing medium advancing mechanism is a lead advancing mechanism and the lead advancing mechanism has a lead tank, a chuck coupled to the lead tank, a chuck ring surrounding an outer surface of the chuck, the sleeve disposed so as to be able to contact a rear end of the chuck ring, and a chuck spring interposed between the sleeve and the lead tank to force the lead tank backward relative to the sleeve.

7. The writing instrument as claimed in any one of claims 1 to 5 wherein the writing medium advancing mechanism has a refill advancing mechanism and the refill advancing mechanism has a refill, the sleeve, a spring interposed between the sleeve and the refill to force the refill backward relative to the sleeve, rotating cam means contacting a rear end of the refill, knocking cam means for pushing the rotating cam means forward, and cam body means having cam surfaces for making the rotating cam means rotate by a predetermined angle along the cam surface of the cam body means.

* * * * *